US006578555B2

(12) United States Patent
Sykes

(10) Patent No.: US 6,578,555 B2
(45) Date of Patent: Jun. 17, 2003

(54) CONTROL METHOD

(75) Inventor: Martin A P Sykes, Kent (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/079,672

(22) Filed: Feb. 20, 2002

(65) Prior Publication Data

US 2002/0117150 A1 Aug. 29, 2002

(30) Foreign Application Priority Data

Feb. 10, 2001 (GB) ..... 0104213

(51) Int. Cl.[7] ..... F02M 5/00
(52) U.S. Cl. ..... 123/479; 123/198 D; 123/446
(58) Field of Search ..... 123/446, 450, 123/458, 295, 179.17, 198 D, 479

(56) References Cited

U.S. PATENT DOCUMENTS 4,884,545 A * 12/1989 Mathis ..... 123/447
5,937,826 A 8/1999 Olson et al. ..... 123/447
6,024,064 A * 2/2000 Kato et al. ..... 123/179.17
6,032,639 A * 3/2000 Goto et al. ..... 123/295
6,053,147 A 4/2000 Hemmerlein et al. ..... 123/447
6,293,253 B1 * 9/2001 Arnold et al. ..... 123/458

FOREIGN PATENT DOCUMENTS

JP 11324854 11/1999

* cited by examiner

*Primary Examiner*—Carl S. Miller
(74) *Attorney, Agent, or Firm*—Thomas N. Twomey

(57) ABSTRACT

A method of controlling the operation of an engine fuel system including at least one fuel injector, a high pressure fuel pump for delivering fuel to the injector and a pressure sensor arranged to provide an output signal indicative of the pressure of fuel delivered to the injector, comprises the steps of controlling the rate of flow of fuel delivered from the pump to the injector by means of a metering valve arrangement supplied with a control current, measuring the speed of the engine and monitoring the status of the pressure sensor so as to determine whether a fault condition has occurred within the sensor. In the event that a fault condition has occurred in the pressure sensor, the control current supplied to the metering valve arrangement is varied in response to the measured engine speed signal so as to maintain operation of the engine at a substantially constant, predetermined engine speed. The invention also relates a fuel system for implementing the control method.

13 Claims, 3 Drawing Sheets

CONTROL METHOD

FIELD OF THE INVENTION

The invention relates to a method of controlling a fuel system for use in delivering fuel to an internal combustion engine. In particular, the invention relates to a method of controlling the fuel system so as to provide a limp-home capability in the event that a fault condition occurs within the system. The invention also relates to a fuel system arranged to provide a limp-home capability in the event of such a fault.

BACKGROUND OF THE INVENTION

A common rail system typically includes a source of fuel in the form of a common rail which is charged with fuel at high pressure by means of a high pressure fuel pump. The common rail delivers fuel to a plurality of injectors, each one being arranged to inject fuel into an associated engine cylinder. The common rail is provided with a rail pressure sensor providing an output signal indicative of the pressure of fuel within the common rail and, hence, the pressure of fuel delivered to the injectors.

The quantity of fuel to be injected during an injection event is calculated by means of an appropriately programmed control unit in response to a driver demand signal and other operating conditions of the engine, for example speed and temperature. The quantity of fuel delivered during an injection event depends upon both the pressure of fuel within the common rail and the duration for which an injection occurs.

It is known to provide the fuel system with a pressure regulating valve arranged to control the pressure of fuel supplied to the high pressure fuel pump and, hence, the pressure of fuel within the common rail. The pressure of fuel within the common rail can be varied by varying the current supplied to the pressure regulating valve in response to the output signal from the rail pressure sensor.

The supply of current to the pressure regulating valve is varied by the control unit in response to the pressure sensor output signal so as to ensure the required rail pressure is maintained.

If a fault occurs in the rail pressure sensor, this method can no longer be used to maintain operation of the engine. However, by controlling the current supplied to the pressure regulating valve, it is possible to provide a vehicle limp-home capability as the current supplied to the pressure regulating valve is related directly to the pressure of fuel within the common rail. Therefore, if the pressure sensor fails, the engine can still be operated sufficiently to enable the vehicle to be driven to a service center for repair.

If the fuel system is not provided with a pressure regulating valve, it is not possible to control operation of the engine in this way in the event that a fault occurs in the rail pressure sensor. In such systems, failure of the rail pressure sensor causes engine operation to be halted, leaving the vehicle immobilized until the fault can be corrected.

It is an object of the present invention to provide a method of controlling a fuel system such that engine operation can be maintained if a fault occurs in the pressure sensor, even if the fuel system is not provided with a pressure regulating valve.

By way of background to the present invention, U.S. Pat. No. 5,937,826 describes a control system for an internal combustion engine in which a low pressure pump supplies a pressure regulated supply of fuel to a high pressure pump. High pressure fuel from the pump is delivered to an accumulator under the control of ON/OFF valves, each of which controls the fuel flow from a respective pumping cylinder of the pump. The high pressure pump is controlled in response to a requested fuelling signal, an engine speed signal and a pressure output from a pressure sensor. Under normal operating conditions, the system operates closed loop such that fuel pressure within the accumulator is controlled by switching the high pressure pump valves between ON and OFF (open and closed) states in response to the requested fuelling signal, the engine speed signal and the pressure output. In the event of a fault occurring in the pressure sensor, the system operates open loop in response to a predicted pump command signal based on fuel command and engine speed. An appropriate pump command value is determined, either directly or by interpolation from a look up table, for various fuel command values and engine speed values.

SUMMARY OF THE INVENTION AND ADVANTAGES

According to a first aspect of the present invention, a method of controlling the operation of an engine fuel system including at least one fuel injector, a source of fuel at high pressure for delivering fuel to the injector and a pressure sensor providing an output signal indicative of the pressure of fuel delivered to the injector, comprises the steps of:

- controlling the rate of flow of fuel delivered from the source to the injector by means of a metering valve arrangement supplied with a control current;
- measuring the speed of the engine;
- monitoring the status of the pressure sensor so as to determine whether a fault condition has occurred; and
- in the event that a fault condition has occurred, varying the control current supplied to the metering valve arrangement in response to the measured engine speed so as to maintain engine operation at a substantially constant speed.

The invention provides the advantage that, even in the event of failure of the pressure sensor, operation of the engine can be maintained to provide a limp-home capability. This enables the driver of the vehicle to move the vehicle to a safe location or to a service centre. In the failure mode, the system operates closed loop by feeding the measured engine speed to determine a control current for the metering valve arrangement.

The method is particularly suitable for use in controlling the operation of a common rail fuel system comprising a common rail charged with fuel by means a high pressure fuel pump, wherein the common rail is arranged to deliver fuel to the injector.

In a preferred embodiment, the method includes the step of moving a valve member of the metering valve arrangement through a range of operating positions so as to vary the rate of flow of fuel to the high pressure pump and, hence, the pressure within the common rail.

The metering valve member is conveniently arranged to vary the extent to which an orifice in a flow path between a transfer pump and the high pressure pump is opened.

Preferably, the method comprises the further steps of providing a pressure control means for supplying the current to the metering valve arrangement, and providing an injection control means for supplying an injection current to the injector so as to control the duration for which an injection of fuel occurs.

Conveniently, the pressure control means and the injection control means form part of a control unit programmed with an appropriate control algorithm.

The method may include the step of generating a predetermined injection current to be supplied to the injector arrangement in the event that a fault condition occurs so as to set a duration for which an injection of fuel occurs, such that the quantity of fuel delivered by the injector depends only upon the control current supplied to the metering valve arrangement.

In use, if a fault occurs in the pressure sensor, the injection control means provide a predetermined injection current to the injector to control the duration for which an injection of fuel occurs. The speed of the engine is measured and, if the measured speed is less than a predetermined, demanded speed, the control current supplied to the metering valve arrangement is increased so as to increase the rate of flow of fuel from the high pressure pump to the injector. As a result, the pressure of fuel supplied to the injector is increased, thereby causing an increase in the quantity of fuel injected by the injector and, hence, an increase in engine speed. If the measured speed increases to a value greater than the demanded speed, the control current supplied to the metering valve arrangement is reduced so as to reduce the rate of flow of fuel to the injector, thereby reducing the pressure of fuel supplied to the injector. The quantity of fuel delivered by the injector is therefore reduced and, hence, the engine speed is reduced. In this way, the engine speed can be maintained at a substantially constant speed, sufficient to enable the vehicle to be driven to an appropriate location for service or repair.

Preferably, the predetermined injection current sets a predetermined duration for which an injection of fuel occurs, and is derived from a demanded engine speed which is typically greater than the idling speed of the engine.

It will be appreciated that the metering valve arrangement may be arranged such that an increase in the control current supplied to the metering valve arrangement causes a decrease in the rate of flow of fuel supplied to the high pressure fuel pump, and hence a decrease in the pressure of fuel supplied to the injectors.

According to a second aspect of the invention, a fuel system for an engine includes at least one fuel injector, a source of fuel at high pressure for delivering fuel to the injector, a pressure sensor arranged to provide an output signal indicative of the pressure of fuel delivered to the injector, a metering valve arrangement including a valve member which is movable through a range of operating positions to vary the rate of flow of fuel to the source and, hence, the pressure of fuel to be delivered to the injector, control means for controlling a current supplied to the metering valve arrangement, means for measuring the speed of the engine, a monitor for monitoring the status of the pressure sensor so as to determine whether a fault condition has occurred within the sensor, and wherein the control means is arranged to vary the control current supplied to the metering valve arrangement in response to the measured engine speed so as to maintain engine operation at a substantially constant engine speed in the event that a fault condition is detected by the monitor.

The fuel system may take the form of a common rail fuel system comprising a common rail charged with fuel by means of a high pressure fuel pump which is supplied with fuel by a transfer pump through the metering valve arrangement.

The system may include a pressure control means for supplying the current to the metering valve arrangement and an injection control means for supplying an injection current to the injector so as to control the duration for which an injection of fuel occurs.

Conveniently, the pressure control means and the injection control means form part of a control unit programmed with an appropriate control algorithm.

Other preferred and/or alternative features of the method of the present invention are equally applicable to the apparatus of the second aspect of the invention.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
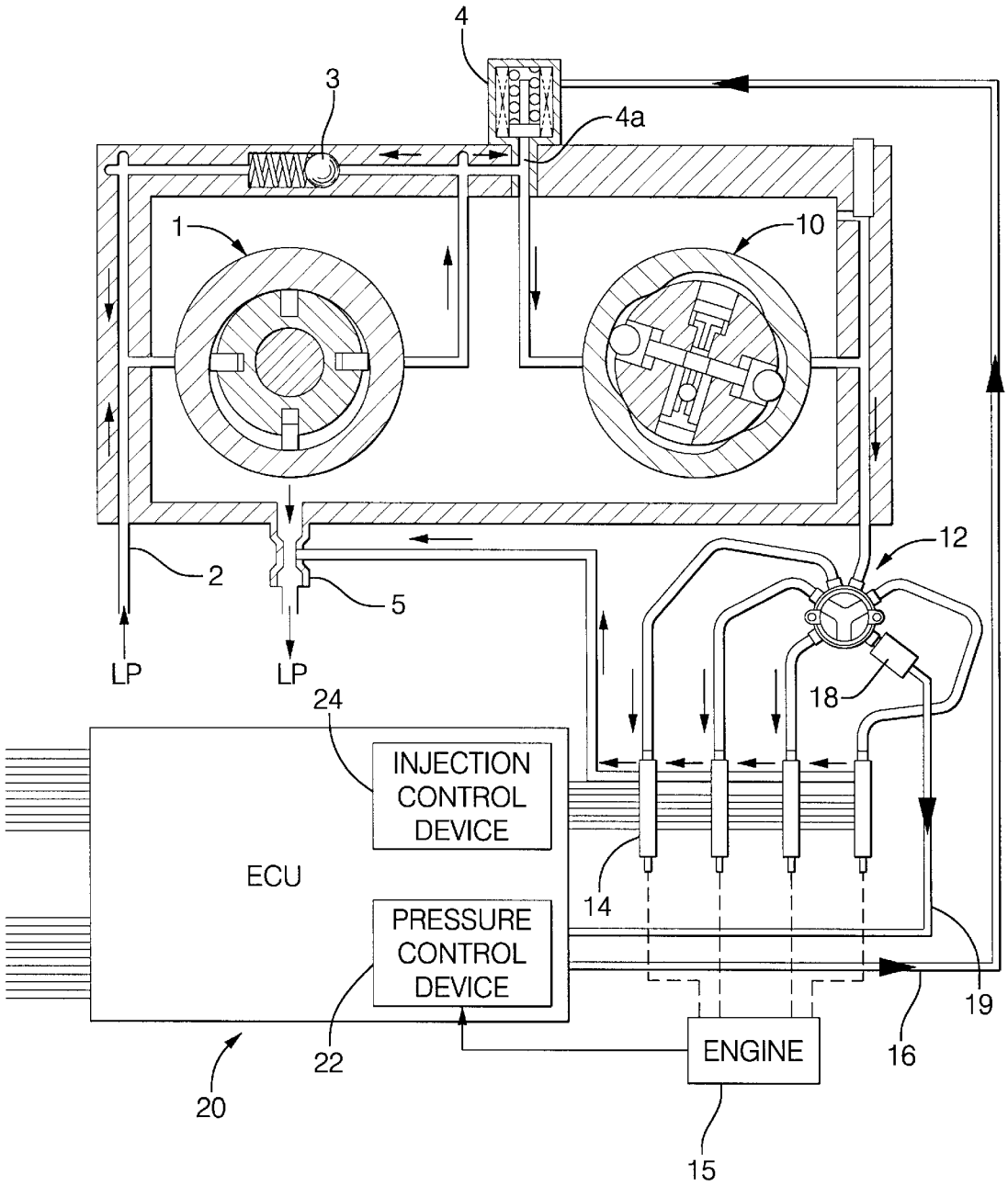
FIG. 1 is a diagram of a fuel system which is operable using the control method of the present invention.

The common rail fuel system in the accompanying drawings includes a pump arrangement comprising a transfer pump 1 and a high pressure pump 10, wherein the transfer pump 1 is arranged to receive low pressure fuel through an inlet 2 and delivers fuel at transfer pressure to the high pressure fuel pump 10 through an inlet metering valve arrangement 4. Typically, the transfer pump 1 and the high pressure pump 10 are driven together by the engine at a drive speed of approximately 50% of engine speed. A transfer pressure regulator 3 is connected across the inlet and outlet of the transfer pump 1 to regulate the pressure of fuel supplied to the inlet metering valve arrangement 4. The pump arrangement is provided with a return flow path to low pressure through an outlet 5 in a conventional manner.

The high pressure pump is arranged to supply fuel at high pressure to a common rail 12. The common rail 12 delivers fuel to a plurality of fuel injectors 14 forming part of an injector arrangement, each of the fuel injectors 14 being arranged to deliver fuel to a cylinder or other combustion space of an associated engine (not shown). Each of the injectors 14 has a backleak connection to permit leakage fuel to flow through a return flow path through the outlet 5 to low pressure.

The metering valve arrangement 4 is operable in response to a supply current signal 16 generated by an engine control unit (ECU) 20 to control the rate of flow of fuel to the high pressure pump 10. The metering valve arrangement 4 takes the form of a proportional valve, including a valve member 4*a* which is movable through a range of operating positions under the influence of an actuator. The actuator is supplied with the current signal 16 to vary the extent to which an orifice of the arrangement 4 located in the flow path between the transfer pump 1 and the high pressure pump 10 is opened by the valve member 4. The extent to which the orifice is opened determines the rate of flow of fuel between the transfer pump 1 and the high pressure pump 10. If the metering valve member 4*a* is moved to a first, partially open position, the rate of flow of fuel to the high pressure pump 10 is relatively low, whereas if the metering valve member 4*a* is moved to a more open position, the rate of flow of fuel to the high pressure pump 10 is higher. Therefore, by varying the current 16 supplied to the actuator, the position of the metering valve member 4*a* can be varied, and the rate of flow of fuel delivered to the high pressure pump 10, and hence the rate of flow of fuel delivered to the common rail 12, can be controlled. The rate of flow of fuel supplied to the common rail 12 determines the pressure of fuel within the common rail 12 (referred to as "rail pressure") and, hence, the pressure of fuel supplied to the injectors 14. The common rail 12 is provided with a pressure sensor 18 which generates a rail pressure output signal 19 indicative of the pressure of fuel within the common rail 12 and, hence, the pressure of fuel delivered to the injectors 14.

The flow of fuel delivered by the high pressure pump 10 to the rail 12 is dependent upon rail pressure, the speed of operation of the high pressure pump 10 and the rate of flow of fuel between the transfer pump 1 and the high pressure pump 10 through the metering valve arrangement 4. The rate of flow of fuel through the orifice of the metering valve arrangement 4 is proportional to the square root of the pressure difference across the inlet and outlet sides of the arrangement. This pressure difference depends upon fuel pressure in the rail, and also on quantity of fuel delivered to the rail 12 during the previous pumping cycle, and it is not therefore possible to predict the rate of flow of fuel delivered by the high pressure pump 10 to the rail 12 from the position of the metering valve arrangement 4, nor by measuring the current supplied to the metering valve arrangement 4. In order to control the rate of flow of fuel from the high pressure pump 10, it is therefore important to feed back the rail pressure output signal 19 to a pressure control scheme of the engine control unit 20.

Figure 2:
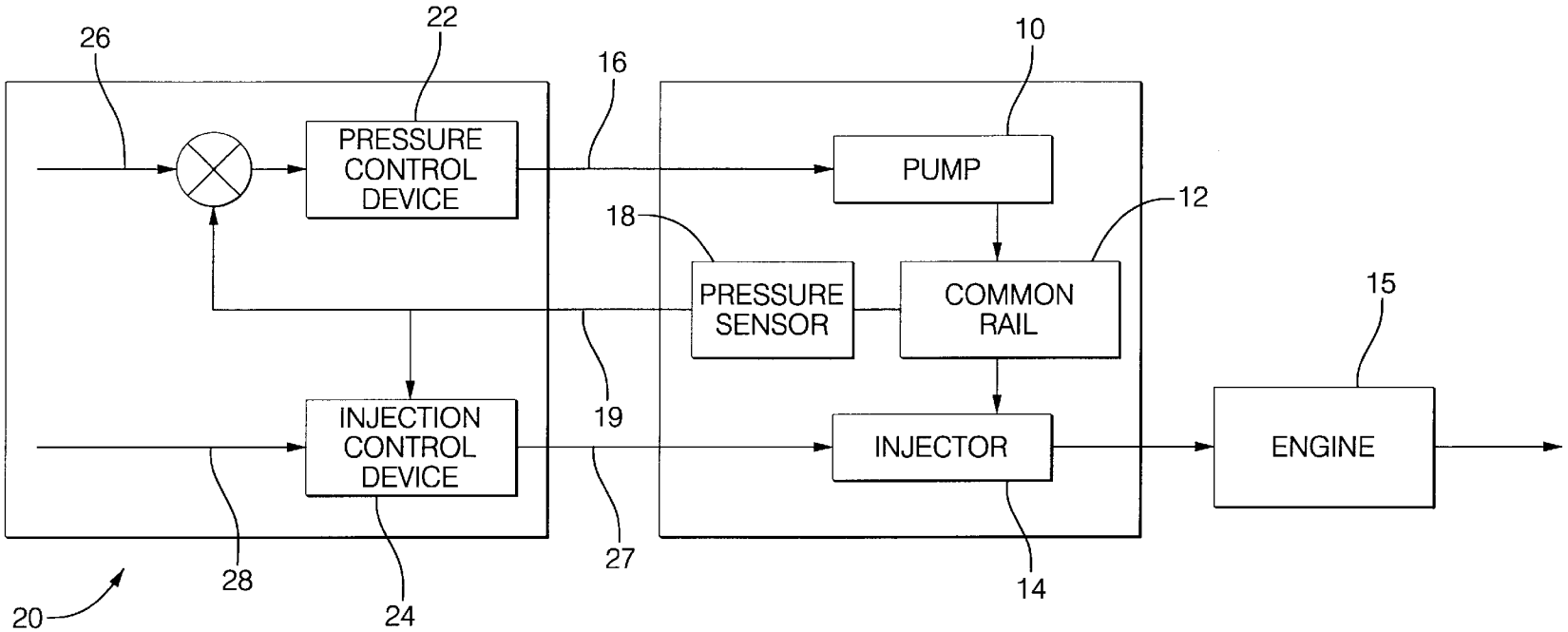
FIG. 2 is a schematic diagram of parts of the fuel system in FIG. 1 to illustrate the control signals used to control system operation under normal operating conditions.

FIG. 2 is a schematic diagram of the fuel system in FIG. 1 and illustrates the control signals used to control fuel injection during normal operation of the fuel system. The quantity of fuel delivered by an injector 14 during an injection event is determined by the duration for which the injection occurs and the pressure of fuel delivered to the injector 14. The quantity of fuel delivered during an injection event is controlled by means of the engine control unit 20 which includes a pressure control device or unit 22, for controlling the pressure of fuel supplied to the injector 14, and an injection control device or unit 24 for controlling the duration for which the injection occurs.

The status of the pressure sensor 18 is monitored by appropriate programming of the control unit 20. In normal operation, when the pressure sensor 18 is functioning correctly, the control unit 20 generates a pressure demand signal 26 in response to signals indicative of operating parameters of the engine. The method of calculating an appropriate pressure demand signal 26 typically involves the use of a look-up table or calibrated data map and would be familiar to a person skilled in the art of engine control systems. In response to the pressure demand signal 26, the pressure control unit 22 controls the current 16 supplied to the metering valve arrangement so as to vary the rate of flow of fuel to the high pressure pump 10, and hence to the common rail 12, to ensure the demanded fuel pressure is achieved.

The control unit 20 also generates a fuel demand signal 28 which is input to the injection control unit 24 in response to a driver demand signal (not shown) and other operating parameters of the engine, for example speed and temperature. The output signal 19 generated by the pressure sensor 18 is also input to the injection control unit 24. In response to the fuel demand signal 28 and the output signal 19 from the pressure sensor 18, the injection control unit 24 generates an injection current 27 which is supplied to the injector 14 so as to control the duration of the injection of fuel. The method by which the fuel demand signal 28 is derived typically involves the use of a look-up table or calibrated data map and would be familiar to a person skilled in the art. The quantity of fuel delivered to the engine 15, which depends on both the pressure of fuel supplied by the common rail 12 and the duration for which an injection occurs, determines the speed at which the engine operates. The load under which the engine operates also influences the engine speed.

In the event that a fault occurs in the pressure sensor 18, such that the pressure control unit 22 no longer receives the output signal 19 from the sensor 18 or does not receive a meaningful output signal 19, the pressure of fuel in the common rail 12 can no longer be controlled using the technique described previously. Furthermore, as the injection control unit 24 also interacts with the pressure control unit 22, the injection control unit 24 can no longer control the injection current 27 so as to ensure the demanded amount of fuel is injected. Thus, if a fault condition occurs in the pressure sensor 18, the fuel system becomes unstable and the engine is shut down. The control unit 20 is programmed to ensure the engine will not restart until the pressure sensor fault has been corrected.

Figure 3:
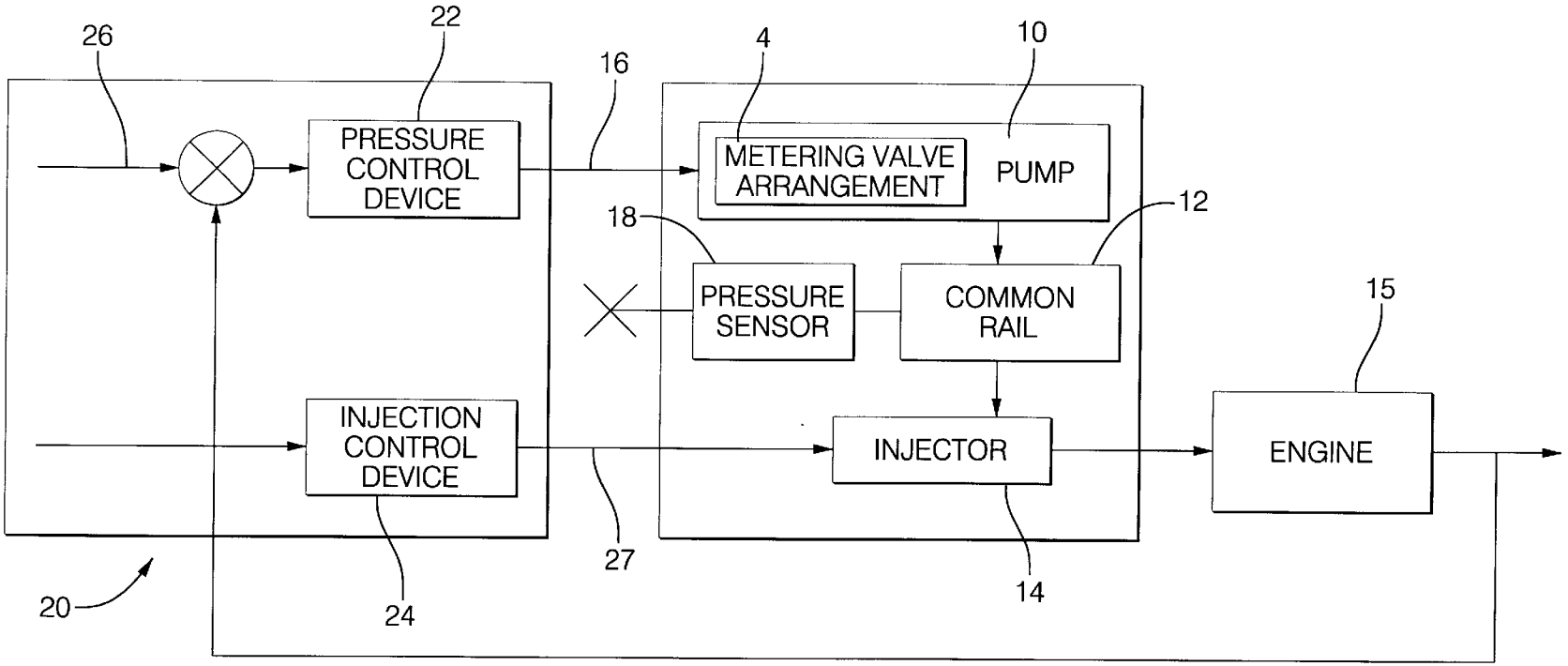
FIG. 3 is a similar diagram to that shown in FIG. 2, but to illustrate the signals used to control system operation in the event that a fault occurs in the pressure sensor.

FIG. 3 shows an engine control scheme in accordance with an embodiment of the present invention, in which an engine speed signal 23 indicative of the speed at which the engine is running is fed back to the pressure control unit 22. If a pressure sensor fault is detected, the control current 16 supplied by the pressure control unit 22 to move the metering valve member 4*a* to the desired position is varied in response to the measured engine speed signal 23. The measured engine speed signal 23 is also fed back to the injection control unit 24. Upon detection of a fault condition, the control unit 20 prompts the injection control unit 24 to supply a constant, predetermined injection current to the injector 14 determined by a pre-set engine speed demand signal 30. The predetermined injection current supplied to the injector 14 sets a substantially fixed duration for which an injection of fuel occurs.

The amount of fuel delivered by an injector 14 to the engine 15 is determined by the injection current 27 supplied by the injection control unit 24 and the pressure of fuel within the common rail 12. Thus, by ensuring the injection current 27 supplied by the injection control unit 24 is maintained at the constant predetermined current, the quantity of fuel delivered by an injector 14 depends only on rail pressure. The measured engine speed signal 23 is fed back to the pressure control unit 22 such that, if the measured engine speed falls below the demanded engine speed signal 30, the current 16 supplied to the metering valve arrangement 4 is increased so as to increase the rate of flow of fuel to the high pressure pump 10. The rate of flow of fuel into the common rail 12 is therefore also increased, thereby increasing the pressure of fuel within the common rail 12. As the pressure of fuel in the common rail 12 is increased, the pressure of fuel delivered to the injector 14 is increased, the amount of fuel delivered to the engine is increased and the speed of the engine is increased. The engine speed demand signal 30 is preferably selected to be a speed greater than the usual idling speed of the engine, typically 1,200 rpm. In this way, the engine speed is maintained at a speed sufficient to enable the vehicle to be driven to a service centre or other safe location.

If the measured engine speed signal 23 increases above the predetermined engine speed, the pressure control unit 22 responds by reducing the current 16 supplied to the metering valve arrangement, thereby reducing the rate of flow of fuel to the high pressure pump 10, and hence to the common rail 12, so as to reduce the pressure of fuel delivered to the injector 14. As a result, the amount of fuel delivered to the engine 15 is reduced, thereby causing the engine speed to be reduced. By maintaining the injection current 27 supplied to the injector 14 at a substantially constant value and by varying the pressure of fuel within the common rail 12 in response to any deviation of the engine speed from the demanded engine speed, it is possible to maintain operation of the engine even in the event that a fault condition occurs in the pressure sensor 18.

The invention provides the advantage that, even in common rail fuel systems which are not provided with a pressure regulating valve, it is possible to provide a limp-home capability in the event that failure of the rail pressure sensor occurs.

It will be appreciated that the method of the present invention is not limited to use in a common rail system, but may be employed in any high pressure fuel system for delivering fuel to an engine.

For the purpose of this specification, reference to the occurrence of a fault in the pressure sensor shall be taken to mean any degree of failure of the sensor including, but not limited to, operation of the pressure sensor being terminated.

Obviously, many modifications and variations of the present invention are possible in light of the above teachings. The invention may be practiced otherwise than as specifically described within the scope of the appended claims.

What is claimed is:

1. A method of controlling the operation of an engine fuel system including at least one fuel injector, a source of fuel at high pressure for delivering fuel to the injector and a pressure sensor arranged to provide an output signal indicative of the pressure of fuel delivered to the injector, the method comprising:

controlling the rate of flow of fuel delivered from the source to the injector by means of a metering valve arrangement supplied with a control current;

measuring the speed of the engine;

monitoring the status of the pressure sensor so as to determine whether a fault condition has occurred within the sensor; and in the event that a fault condition has occurred, varying the control current supplied to the metering valve arrangement in response to the measured engine speed so as to maintain engine operation at a substantially constant engine speed.

2. A method as claimed in claim 1, for use in controlling the operation of a common rail fuel system comprising a common rail charged with fuel by means of a high pressure fuel pump, wherein the common rail is arranged to deliver fuel to the injector.

3. A method as claimed in claim 2, including moving a valve member of the metering valve arrangement through a range of operating positions to vary the rate of flow of fuel to the high pressure fuel pump and, hence, the pressure within the common rail.

4. A control method as claimed in claim 3, whereby the metering valve member is arranged to vary the extent to which an orifice in a flow path between a transfer pump and the high pressure fuel pump is opened.

5. A method as claimed in claim 4, comprising:

providing a pressure control means for supplying the control current to the metering valve arrangement; and providing an injection control arrangement for supplying an injection current to the injector so as to control the duration for which an injection of fuel occurs.

6. A method as claimed in claim 1, comprising generating a predetermined injection current in the event that a fault condition occurs such that the quantity of fuel delivered by the injector is dependent only upon the control current supplied to the metering valve arrangement.

7. A method as claimed in claim 5, whereby, if the measured engine speed signal is less than the demanded engine speed, the control current supplied to the metering valve arrangement is increased so as to increase the rate of flow of fuel to the source, thereby to increase the pressure of fuel therein and, if the measured engine speed signal falls below the demanded engine speed, the control current supplied to the metering valve arrangement is reduced so as to reduce the rate of flow of fuel to the source, thereby to reduce the pressure of fuel therein.

8. A method as claimed in claim 6, wherein the predetermined injection current is derived from a demanded engine speed.

9. A method as claimed in claim 8, wherein the demanded engine speed is greater than the idling speed of the engine.

10. A fuel system for an engine including:

at least one fuel injector;

a source of fuel at high pressure for delivering fuel to the injector;

a pressure sensor arranged to provide an output signal indicative of the pressure of fuel delivered to the injector;

a metering valve arrangement including a valve member which is movable through a range of operating positions to vary the rate of flow of fuel to the source and, hence, the pressure of fuel to be delivered to the injector;

a control arrangement for controlling a current supplied to the metering valve arrangement;

a speed sensor for measuring the speed of the engine; and a monitor for monitoring the status of the pressure sensor so as to determine whether a fault condition has occurred within the pressure sensor, wherein the control arrangement is arranged to vary the control current supplied to the metering valve arrangement in response to the measured engine speed so as to maintain engine operation at a substantially constant engine speed in the event that a fault condition is detected by the monitor.

11. A fuel system as claimed in claim 10, wherein the source includes a high pressure fuel pump, the fuel system further comprising a transfer pump for supplying fuel to the high pressure fuel pump through the metering valve arrangement.

12. A fuel system as claimed in claim 10, including a pressure control device for supplying the current to the metering valve arrangement and an injection control device for supplying an injection current to the injector so as to control the duration for which an injection of fuel occurs.

13. A fuel system as claimed in claim 12, wherein the pressure control device and the injection control device form part of a control unit programmed with a control algorithm.

* * * * *